US011791081B2

(12) United States Patent
Seon et al.

(10) Patent No.: US 11,791,081 B2
(45) Date of Patent: Oct. 17, 2023

(54) COIL DRIVING DEVICE

(71) Applicant: LS ELECTRIC CO., LTD., Anyang-si (KR)

(72) Inventors: Jongkug Seon, Anyang-si (KR); Woojin Jo, Anyang-si (KR); Jaehyeong Ko, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 44 days.

(21) Appl. No.: 17/638,587

(22) PCT Filed: Apr. 28, 2020

(86) PCT No.: PCT/KR2020/005574
§ 371 (c)(1),
(2) Date: Feb. 25, 2022

(87) PCT Pub. No.: WO2021/040184
PCT Pub. Date: Mar. 4, 2021

(65) Prior Publication Data

US 2022/0293322 A1 Sep. 15, 2022

(30) Foreign Application Priority Data

Aug. 26, 2019 (KR) ..... 10-2019-0104663

(51) Int. Cl.
*H01H 47/00* (2006.01)
*H01F 7/18* (2006.01)
(Continued)

(52) U.S. Cl.
CPC ..... *H01F 7/1844* (2013.01); *H01F 7/064* (2013.01); *H01H 1/54* (2013.01); *H01H 47/22* (2013.01); *H01F 2007/1888* (2013.01)

(58) Field of Classification Search
None
See application file for complete search history.

(56) References Cited

U.S. PATENT DOCUMENTS 5,930,104 A 7/1999 Kadah et al.
2008/0151450 A1* 6/2008 Hsu ..... H05B 41/2855 361/93.7
(Continued)

FOREIGN PATENT DOCUMENTS

JP 2003505853 A 2/2003
JP 2007236126 A 9/2007
(Continued)

OTHER PUBLICATIONS

International Search Report for related International Application No. PCT/KR2020/005574, dated Mar. 4, 2021; (5 pages.
(Continued)

*Primary Examiner* — Stephen W Jackson
(74) *Attorney, Agent, or Firm* — K&L Gates LLP

(57) ABSTRACT

The present disclosure provides a coil driving device comprising: an input voltage sensing unit for sensing an input voltage; a switch unit configured to make a switching operation to supply a driving current to a coil; a PWM circuit unit for outputting a pulse width modulation (PWM) signal for the switching operation of the switch unit; an impedance adjustment unit for varying an impedance value such that the PWM signal is adjusted, thereby limiting the driving current; and a control unit for causing the impedance adjustment unit to vary the impedance value on the basis of the input voltage, thereby adjusting at least one of the duty ratio of the PWM signal and the frequency thereof.

15 Claims, 8 Drawing Sheets

(51) Int. Cl.

| | |
|---|---|
| ***H01F 7/06*** | (2006.01) |
| ***H01H 1/54*** | (2006.01) |
| ***H01H 47/22*** | (2006.01) |

(56) References Cited

U.S. PATENT DOCUMENTS

| | | | | |
|---|---|---|---|---|
| 2013/0114178 | A1 | 5/2013 | Ryo et al. | |
| 2018/0123471 | A1 | 5/2018 | Assal | |
| 2018/0174786 | A1* | 6/2018 | Matsuo | H01H 47/32 |
| 2018/0366288 | A1* | 12/2018 | Thron | H01H 47/325 |

FOREIGN PATENT DOCUMENTS

| | | | |
|---|---|---|---|
| JP | 2013101843 | A | 5/2013 |
| JP | 2014056679 | A | 3/2014 |
| JP | 2014241272 | A | 12/2014 |
| JP | 2015076231 | A | 4/2015 |
| KR | 200222138 | Y1 | 2/2001 |
| KR | 20020086126 | A | 11/2002 |
| KR | 1020050052871 | | 6/2005 |
| KR | 20070062048 | A | 6/2007 |
| KR | 100802910 | B1 | 2/2008 |
| KR | 100827295 | B1 | 5/2008 |
| KR | 100928939 | B1 | 11/2009 |
| KR | 101206215 | B1 | 11/2012 |
| WO | 2005053143 | A1 | 6/2005 |
| WO | 2014174626 | A1 | 10/2014 |
| WO | 2017159070 | A1 | 9/2017 |

OTHER PUBLICATIONS

Written Opinion for related International Application No. PCT/KR2020/005574, dated Mar. 4, 2021; (4 pages.

Search Report for related Korean Application No. 10-2019-0104663; report dated Sep. 20, 2019; (4 pages).

Notice of Allowance for related Korean Application No. 10-2019-0104663, dated Sep. 2, 2020; (3 pages).

Notice of Allowance for related Japanese Application No. 2022-511378, dated Mar. 14, 2023; (3 pages).

Extended European Search Report for related European Application No. 20856676.0; action dated Aug. 8, 2023; (9 pages).

* cited by examiner (a)

(b)

(a)

(b)

(a)

(b)

COIL DRIVING DEVICE

CROSS-REFERENCE TO RELATED APPLICATIONS

This application is the National Stage filing under 35 U.S.C. 371 of International Application No. PCT/KR2020/005574, filed on Apr. 28, 2020, which claims the benefit of earlier filing date of and right of priority to Korean Application No. 10-2019-0104663 filed on Aug. 26, 2019, the contents of which are all hereby incorporated by reference herein in their entirety.

FIELD

The present disclosure relates to a coil driving device, and more particularly, to a coil driving device that is easy to provide a predetermined inrush current and a latching current in a wide voltage range.

BACKGROUND

In a Magnetic Contactor (hereinafter referred to as 'MC') and a relay, an internal coil acts as an actuator, and when a current flows at the coil, a switch operates to conduct electricity.

Here, the MC is a device that turns on and off a load current by an external signal, and uses the principle of an electromagnet.

The MC includes a fixed core at which a coil is wound, and a moving core that is moved by a magnetic force of the fixed core. When power is on, a magnetic force is generated by the fixed core. The moving core is then brought into contact with the fixed core by the magnetic force such that predetermined contacts can substantially be in contact with each other. When power is off, the magnetic force is lost, and the predetermined contacts are separated from each other by a restoration spring attached to the moving core.

In an initial state in which the fixed core and the moving core are separated from each other, a large magnetic force is required to draw the moving core in an opposite direction to an action force of the spring for restoration during an initial operation time by turning power on. After the fixed core and the moving core are in contact with each other, that is, after the contacts are brought into contact with each other, the state is continuously maintained even by a small magnetic force.

The magnetic force is proportional to a current flowing at the coil. When a magnitude of the coil current is maintained constantly even at a variation of an input voltage, the magnetic force is also maintained constantly. Therefore, in order to maintain operating characteristics of the MC constantly, the magnitude of the current should be controlled to be constant. Moreover, since a required magnetic force when the contacts are separated is different from that when the contacts are in contact, a current control is needed for an efficient control of such different magnetic forces.

For the current control, a pulse width modulation (hereinafter referred to as 'PWM') control method by a detection of a coil current is used. The PWM control compares a set current value with a detected current value to adjust On/Off time of a current switching element (pulse width adjustment). When the On time extends, an amount of current increases. On the other hand, When the Off time extends, an amount of current decreases.

Generally, a PWM circuit according to the PWM control method adjusts an amount of current by switching a power semiconductor element (Power Transistor) for adjusting a pulse width.

In addition, a current sensor (resistor, etc.), a feedback circuit, a photo coupler, and the like for monitoring the coil current are required.

In the MC and the relay, a high inrush current for driving the coil is required, and after operation, a change to a latching current lower than the inrush current is required to maintain an electrical connection of the MC or the moving core at an inner side of the coil. Also, since a high current at latching is to not required, the current should be lowered to reduce a coil temperature.

Recently, in a low voltage region or a high voltage region of an input voltage, since the PWM circuit has a limit at a maximum duty ratio of a pulse width, research has been conducted to solve a problem of an insufficient supply of current to the coil due to a limit to a driving current required at the low voltage region, and problems of increased power consumption, heat generation, and lifespan of the coil due to an increase in current at the high voltage region.

SUMMARY

An aspect of the present disclosure is to provide a coil driving device capable of easily supplying predetermined inrush current and latching current in a wide voltage range.

Another aspect of the present disclosure is to provide a coil driving device which is insensitive to temperature changes so as to secure high reliability even when temperature of a coil rises while supplying predetermined inrush current and latching current.

Implementations described herein are not limited to those aspects, and other aspects and advantages not mentioned herein will be understood by the description below and more clearly understood by the implementations of the present disclosure. Further, it will be known easily that those aspects and advantages of the present disclosure can be realized by solutions described in claims and combinations thereof.

A coil driving device according to the present disclosure may an input voltage sensing unit for detecting an input voltage, a switch unit configured to make a switching operation to supply a driving current to a coil, a pulse width modulation (PWM) circuit unit for outputting a PWM signal for the switching operation of the switch unit, an impedance adjustment unit for changing an impedance value such that the PWM signal is adjusted, thereby limiting the driving current, and a control unit for causing the impedance adjustment unit to change the impedance value on the basis of the input voltage, thereby adjusting at least one of the duty ratio of the PWM signal and the frequency thereof The driving current may include at least one of an inrush current for initial driving of a moving contactor or a moving core included in the coil, and a latching current for maintaining contact of the moving contactor or the moving core.

The PWM circuit unit may output the PWM signal including at least one of a first PWM signal for supplying the inrush current and a second PWM signal for supplying the latching current.

The impedance adjustment unit may include a first impedance unit having a first impedance value, a second impedance unit having a second impedance value smaller than the first impedance value, and a time delay unit to delay a point of time to supply the second PWM signal after the first PWM signal changed by the first and second impedance units is supplied to a switching element.

The first and second impedance units may be connected in parallel to each other. The first impedance unit may include a first resistor having the first impedance value and a first switch connected to the first resistor, and the second impedance unit may include a second resistor having the second impedance value and a second switch connected to the second resistor.

When the first and second switches make the switching operation according to a control of the control unit, the first and second impedance units may vary the impedance value according to the first and second impedance values so as to adjust at least one of the duty ratio and the frequency of the PWM signal.

The control unit may include a determination unit to determine to which one of set first, second, and third voltage ranges the input voltage belongs, and a driving control unit to control the first and second impedance units and the time delay unit according to a determination result of the determination unit.

When it is determined that the input voltage belongs to the first voltage range, the driving control unit may turn off the first and second switches to maintain the impedance value as a high impedance, such that the first PWM signal for supplying the inrush current is maintained at a high level, control the time delay unit to delay a point of time after the first PWM signal is supplied, and then turn on the second switch to supply the second PWM signal for supplying the latching current.

When it is determined that the input voltage belongs to the second voltage range, the driving control unit may turn off the first switch and turn on the second switch to maintain the impedance value as a medium impedance by the second impedance value such that the first PWM signal for supplying the inrush current is supplied, control the time delay unit to delay a point of time after the first PWM signal is supplied, and then turn on the second switch such that the second PWM signal for supplying the latching current is supplied.

When it is determined that the input voltage belongs to the third voltage range, the driving control unit may turn off the first switch and turn on the second switch to maintain the impedance value as a medium impedance by the second impedance value such that the first PWM signal for supplying the inrush current is supplied, control the time delay unit to delay a point of time after the first PWM signal is supplied, then turn on the first and second switches such that the second PWM signal for supplying the latching current is supplied, and thus vary the impedance value as a low impedance by the first and second impedance value.

The driving control unit may control the first and second PWM signals such that a duty ratio thereof is shortened and a frequency level is lowered as the voltage range to which the input voltage belongs changes from the first voltage range to the third voltage range.

In addition, the coil driving device according to the present disclosure may further include a rectifier to output the input voltage rectified from an alternating-current (AC) voltage to a direct current (DC) type.

The input voltage sensing unit may include a voltage sensor to detect the input voltage.

The switch unit may be turned on and off by the PWM signal varied by the impedance adjustment unit.

The impedance adjustment unit may include a plurality of impedance units, and a time delay unit to delay a point of time to supply the PWM signal changed by the plurality of impedance units. The plurality of impedance units may have different impedance values.

A coil driving device according to the present disclosure can stably supply an inrush current and a latching current in a wide voltage range, thereby securing reliability of a product.

In addition, the coil driving device according to the present disclosure can supply stable inrush current and latching current by changing a pulse width or frequency input to the PWM circuit according to an input voltage, thereby solving problems of operation at a low voltage, coil stress and life extension, and heat generation at a high voltage.

Further, the coil driving device according to the present disclosure can be designed to allow a capacitor for rectifying an AC voltage to a DC voltage to operate even in a rectifying circuit having many small capacitors, namely, ripples, thereby reducing size and cost.

Furthermore, the coil driving device according to the present disclosure does not need a current sensor (resistor, etc.), a feedback circuit, a photo coupler, and the like for monitoring a coil current, which are required in the related art, thereby simplifying and miniaturizing a product.

In addition to the above-described effects, detailed effects of the present disclosure will be described together while a detailed description of the present disclosure is given.

DETAILED DESCRIPTION

Figure 1:
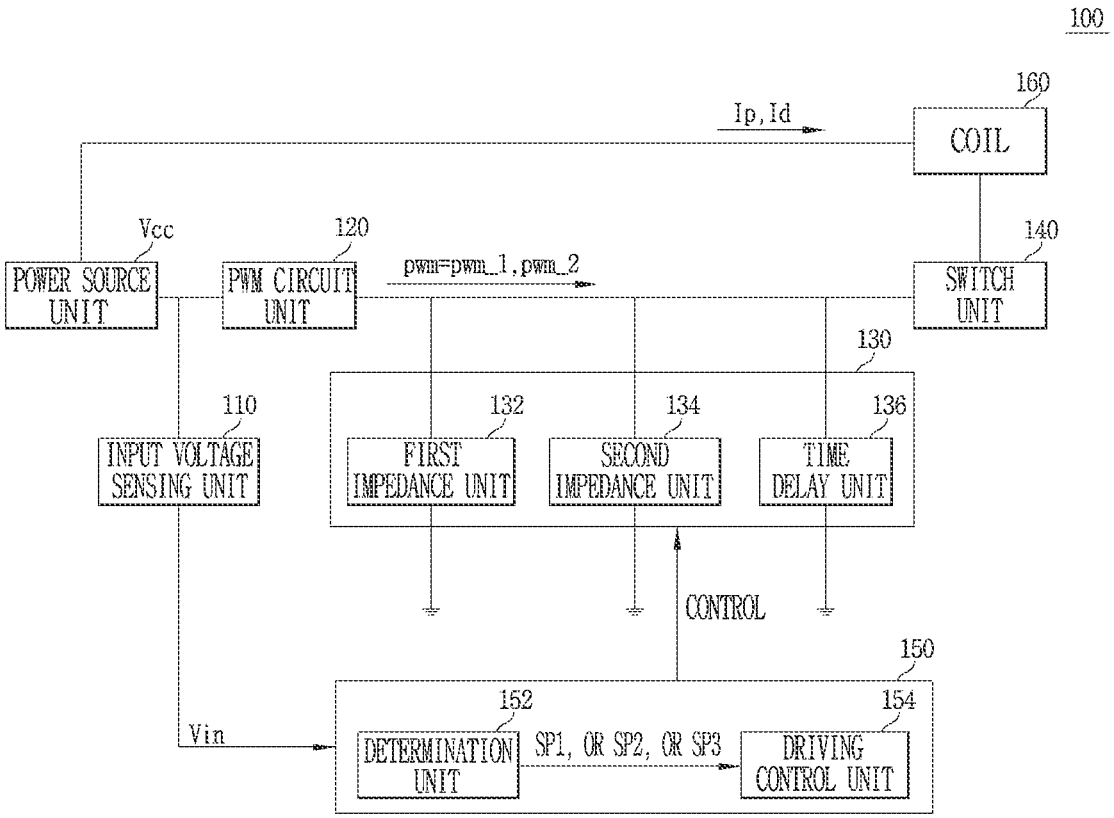
FIG. 1 is a control block diagram illustrating a control configuration of a coil driving device for a magnetic contactor and a relay according to the present disclosure.

It should be noted that, in the following description, only parts necessary for understanding the implementations of the present disclosure will be described, and descriptions of other parts will be omitted so as not to obscure the gist of the present disclosure.

The terms or words used in this specification and claims described below should not be construed as being limited to their ordinary or dictionary meanings, and but be construed as meanings and concepts consistent with the technical idea based on the principle that it the inventors can define appropriate terms for explaining the disclosure in the best way. Therefore, the implementations described in this specification and the configurations illustrated in the drawings are merely illustrative and do not represent all of the technical ideas of the present disclosure, so it should be understood that various equivalents and modified implementations can replace them at the time that this application is filed.

Hereinafter, implementations of the present disclosure will be described in more detail with reference to the accompanying drawings.

Figure 2:
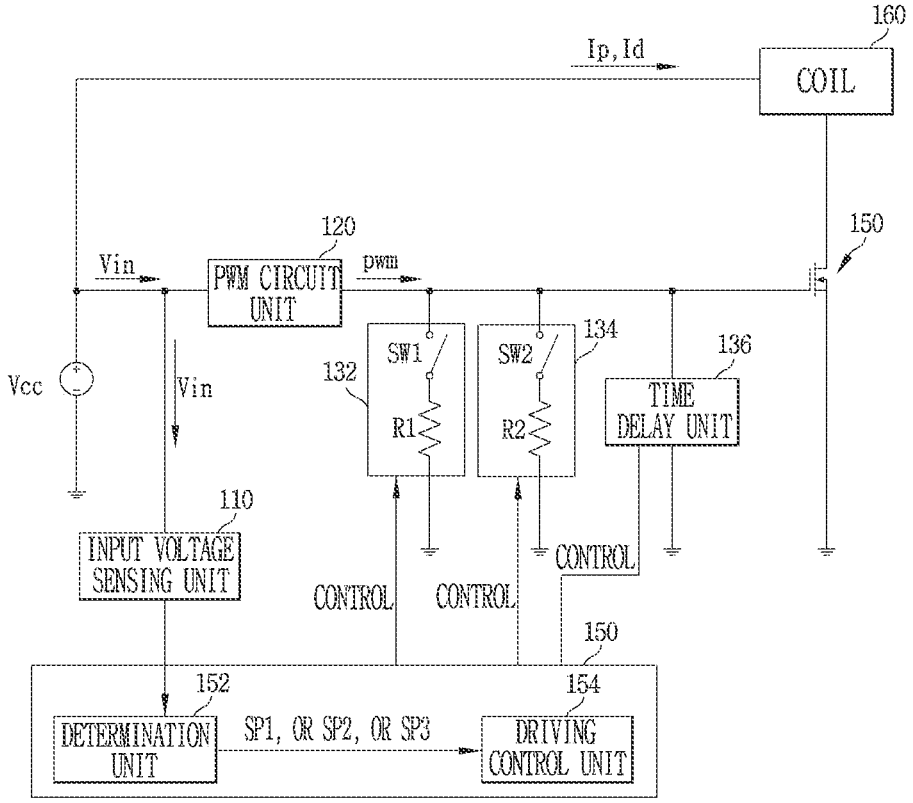
FIG. 2 is a circuit diagram illustrating a coil driving device for a magnetic contactor and a relay according to the present disclosure.

FIG. 1 is a control block diagram illustrating a control configuration of a coil driving device for a magnetic contactor and a relay according to the present disclosure, and FIG. 2 is a circuit diagram illustrating a coil driving device for a magnetic contactor and a relay according to the present disclosure.

Referring to FIGS. 1 and 2, the coil driving device 100 for a magnetic contactor and a relay may include an input voltage sensing unit 110, a PWM circuit unit 120, an impedance adjustment unit 130, a switch unit 140, and a control unit 150.

The input voltage sensing unit 110 may detect an input voltage Vin inputted from a power source unit Vcc. In an implementation, the power source unit Vcc may be a battery or a DC/DC converter which outputs a DC-type input voltage Vin, but may not be limited thereto.

In addition, the power source unit Vcc may include a rectifier for rectifying an input AC voltage into a DC-type input voltage Vin.

The input voltage sensing unit 110 may be a voltage sensor for detecting the input voltage Vin, but may not be limited thereto. Here, the voltage sensor may measure a current corresponding to the input voltage Vin to detect the input voltage Vin.

A pulse width modulation (PWM) circuit unit 120 may output a PWM signal to supply an inrush current Ip for initial driving of a moving contactor or a moving core included in a coil 160 and a latching current Id for holding contact of the moving contactor or the moving core.

Here, the PWM signal pwm may include a first PWM signal pwm_1 for supplying the inrush current Ip and a second PWM signal pwm_2 for supplying the latching current Id.

The PWM circuit unit 120 may be implemented as a single PWM element, and may output a PWM signal pwm depending on a control of the control unit 150.

The impedance adjustment unit 130 may vary at least one of a duty ratio and a frequency of the PWM signal pwm output from the PWM circuit unit 120 to supply to the switch unit 140.

First, the impedance adjustment unit 130 may include first and second impedance units 132 and 134 and a time delay unit 136.

The first impedance unit 132 may include a first switch SW1 and a first resistor R1. The second impedance unit 134 may be connected in parallel with the first impedance unit 132 and may include a second switch SW2 and a second resistor R2.

Here, the first impedance unit 132 may have a first impedance value, and the second impedance unit 134 may have a second impedance value that is smaller than the first impedance value. That is, the first resistor R1 may have a resistance value that is larger than that of the second resistor R2.

The time delay unit 136 may delay a point of time to supply the second PWM signal pwm_2 after the first PWM signal pwm_1 is supplied.

The switch unit 140 may be turned on and off by the PWM signal pwm. The PWM signal pwm may be a signal output to the PWM circuit unit 120 or a signal changed by the impedance adjustment unit 130, but may not be limited thereto.

Here, the switch unit 140 may be switched on and off by the PWM signal pwm to supply the inrush current Ip and the latching current Id to the coil 160.

A diode D may be connected between the PWM circuit unit 120 and the switch unit 140. The diode D may be used to prevent a surge voltage from being supplied to the PWM circuit unit 120.

The control unit 150 may include a determination unit 152 and a driving control unit 154.

The determination unit 152 may determine to which one of set first, second, and third voltage ranges the input voltage Vin detected at the input voltage sensing unit 110 belongs.

Here, the second voltage range may represent a reference voltage range, the first voltage range may be a low voltage range lower than the reference voltage range, and the third voltage range may be a high voltage range higher than the reference voltage range.

The determination unit 152 may output a first determination signal sp1 when the input voltage Vin belongs to the first voltage range, a second determination signal sp2 when the input voltage Vin belongs to the second voltage range, and a third determination signal sp3 when the input voltage Vin belongs to the third voltage range.

The driving control unit 154 may control the impedance adjustment unit 130 according to a determination result of the determination unit 152.

When the first determination signal sp1 is inputted, the driving control unit 154 may control the first and second switches SW1 and SW2 to be turned off such that the first PWM signal pwm_1 for supplying the inrush current Ip is maintained at a high level.

Afterwards, the driving control unit 154 may supply the first PWM signal pwm_1, control the time delay unit 136 to delay a point of time, and then turn on the second switch SW2 such that the second PWM signal pwm_2 for supplying the latching current Id is supplied. This can lower the frequency level of the second PWM signal pwm_2.

That is, when the second switch SW2 is turned on, an impedance may be adjusted according to a second impedance value of the second resistor R2, such that the frequency level of the second PWM signal pwm_2 can be adjusted to be lower than the frequency level of a second PWM signal pwm_2, which is output from the PWM circuit unit 120.

When the second determination signal sp2 is inputted, the driving control unit 154 may turn off the first switch SW1 and turn on the second switch SW2 such that the first PWM signal pwm_1 for supplying the inrush current Ip is supplied.

Afterwards, the driving control unit 154 may supply the first PWM signal pwm_1, control the time delay unit 136 to delay a point of time, and turn on the second switch SW2 such that the second PWM signal pwm_2 for supplying the latching current Id is supplied. This can lower the frequency level of the second PWM signal pwm_2.

That is, when the second switch SW2 is turned on, an impedance may be adjusted according to the second impedance value of the second resistor R2, such that the frequency level of the second PWM pwm_2 can be adjusted to be lower than the frequency level of the second PWM signal pwm_2, which is output from the PWM circuit unit 120.

When the third determination signal sp3 is inputted, the driving control unit 154 may turn off the first switch SW1 and turn on the second switch SW2 such that the first PWM signal pwm_1 for supplying the inrush current Ip is supplied.

Afterwards, the driving control unit 154 may supply the first PWM signal pwm_1, control the time delay unit 136 to delay a point of time, and turn on the first and second switches SW1 and SW2 such that the second PWM signal pwm_2 for supplying the latching current Id is supplied. This can lower the frequency level of the second PWM signal pwm_2.

That is, when the first and second switches SW1 and SW2 are turned on, an impedance may be adjusted according to the first and second impedance values of the first and second resistors R1 and R2, such that the frequency level of the second PWM signal pwm_2 can be adjusted to be lower than the frequency level of the second PWM signal pwm_2, which is output from the PWM circuit unit 120.

In brief summary, as the voltage range to which the input voltage Vin belongs changes from the first voltage range to the third voltage range, the PWM signal pwm may be adjusted such that the frequency level is lowered and the duty ratio is shortened.

As described above, the input voltage Vin has been described to belong to any one of the first to third voltage ranges. However, but the input voltage Vin may be interpreted as belonging to any of three or more voltage ranges, and the present disclosure may not be limited thereto.

Figure 3:
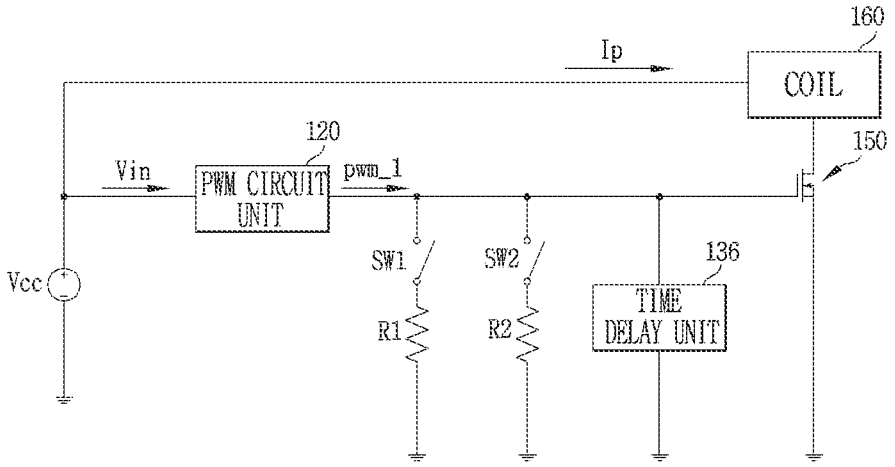
FIG. 3 is an operation circuit diagram illustrating a first implementation of a coil driving device for a magnetic contactor and a relay according to the present disclosure.
Figure 3:
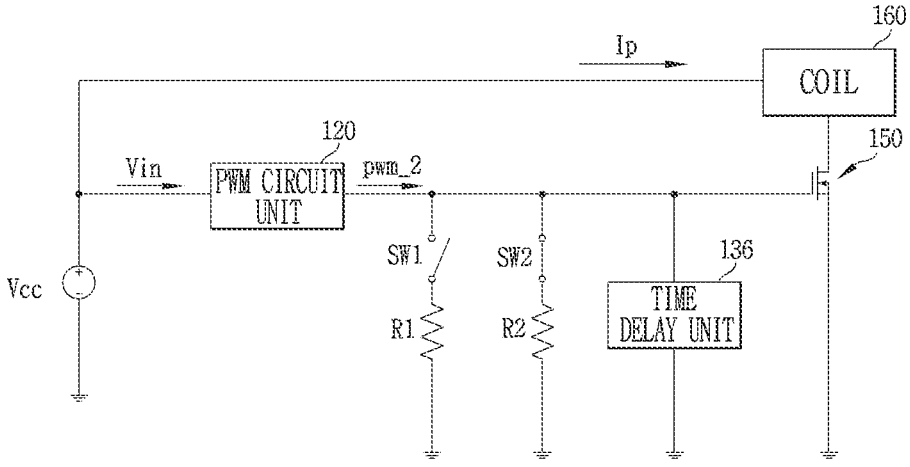
Figure 4:
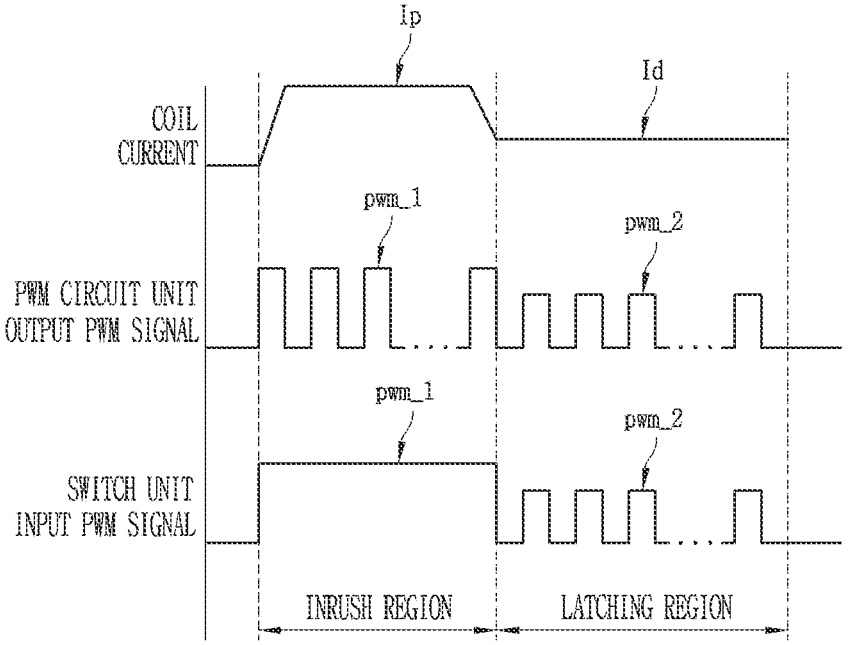
FIG. 4 illustrates a PWM signal and a PWM signal inputted to a switch unit in the operation circuit diagram of FIG. 3.

FIG. 3 is an operation circuit diagram illustrating an implementation of a coil driving device for a magnetic contactor and a relay according to the present disclosure, and FIG. 4 illustrates a PWM signal and a PWM signal inputted to a switch unit in the operation circuit diagram of FIG. 3.

First, FIGS. 3 and 4 illustrate a circuit operation and a PWM signal when the input voltage Vin belongs to the first voltage range.

First, the PWM circuit unit 120 may output the first PWM signal pwm_1 for supplying the inrush current Ip for initial driving of the moving contactor or the moving core included in the coil 160 according to the input voltage Vin.

At this point, when the input voltage Vin detected by the input voltage sensing unit 110 belongs to the first voltage range, the control unit 150 may confirm that the input voltage Vin is lower than a normal voltage.

The control unit 150 may control the first and second switches SW1 and SW2 to be turned off such that the frequency level of the first PWM signal pwm_1 is maintained at a high level.

Here, the diode D may be connected between the PWM circuit unit 120 and the switch unit 140. The diode D may be used to prevent a surge voltage from being supplied to the PWM circuit unit 120.

The frequency level of the first PWM signal pwm_1 may be maintained at the high level by at least one of a capacitor and an inductor disposed at a rear end of the time delay unit 136, and may not be limited thereto.

That is, as illustrated in FIG. 4, although the first PWM signal pwm_1 is outputted with a frequency and a duty ratio, the frequency level of the first PWM signal pwm_1 inputted to the switch unit 140 may be maintained at the high level.

After the first PWM signal pwm_1 is supplied, the time delay unit 136 may delay a point of time. The PWM circuit unit 120 may then output the second PWM signal pwm_2 such that the latching current Id for maintaining the contact of the moving contactor or the moving core is supplied.

The control unit 150 may turn on the second switch SW2 such that the second PWM signal pwm_2 is supplied, so as to lower the frequency level of the second PWM signal pwm_2.

That is, when the second switch SW2 is turned on, the impedance may be adjusted according to the second impedance value by the second resistor R2, such that the frequency level of the second PWM signal pwm_2 can be adjusted to be lower than the frequency level of the second PWM signal pwm_2, which is output from the PWM circuit unit 120.

That is, as illustrated in FIG. 4, the frequency level of the second PWM signal pwm_2 output from the PWM circuit unit 120 may be a high level, but the frequency level of the second PWM signal pwm_2 supplied to the switch unit 140 may be varied to be lower than the high level.

Figure 5:
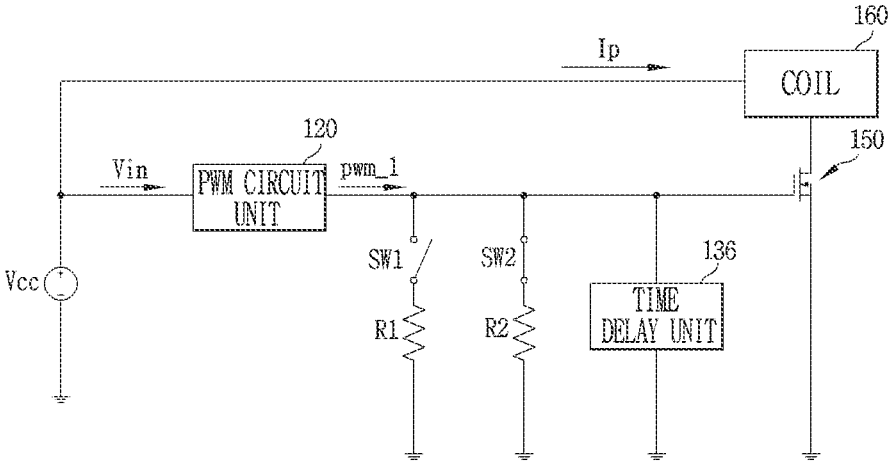
FIG. 5 is an operation circuit diagram illustrating a second implementation of a coil driving device for a magnetic contactor and a relay according to the present disclosure.
Figure 5:
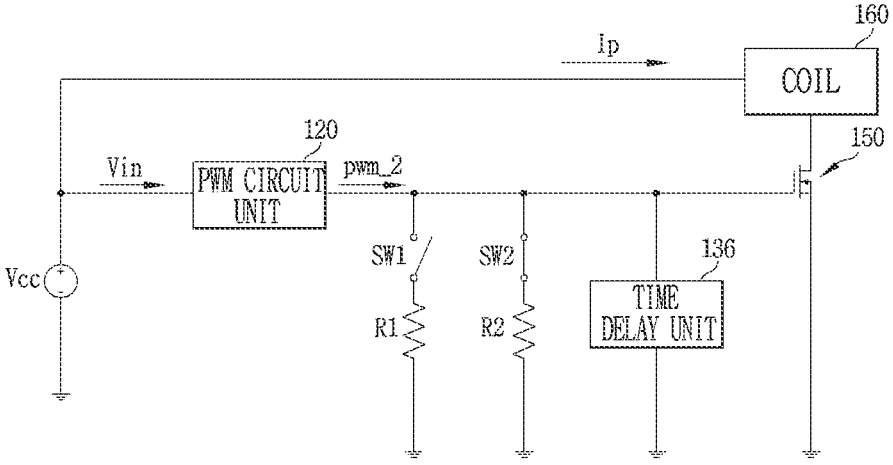
Figure 6:
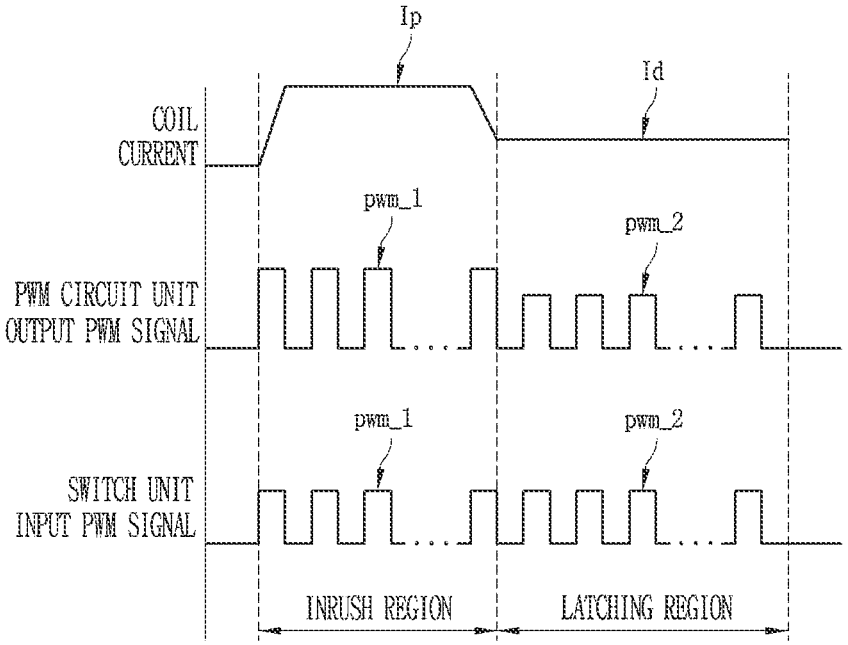
FIG. 6 is a PWM signal and a PWM signal inputted to a switch unit in the operation circuit diagram of FIG. 5.

FIG. 5 is an operation circuit diagram illustrating a second implementation of a coil driving device for a magnetic contactor and a relay according to the present disclosure, and FIG. 6 illustrates a PWM signal and a PWM signal inputted to a switch unit in the operation circuit diagram of FIG. 5.

First, FIGS. 5 and 6 illustrate a circuit operation and a PWM signal when the input voltage Vin belongs to the second voltage range.

First, the PWM circuit unit 120 may output the first PWM signal pwm_1 for supplying the inrush current Ip for initial driving of the moving contactor or the moving core included in the coil 160 according to the input voltage Vin.

At this point, when the input voltage Vin detected by the input voltage sensing unit 110 belongs to the second voltage range, the control unit 150 may confirm that the input voltage Vin is a normal voltage.

The control unit 150 may turn off the first switch SW1 and turn on the second switch SW2 such that the first PWM signal pwm_1 is supplied to the switch unit 140.

As illustrated in FIG. 6, the first PWM signal pwm_1 may be outputted with a frequency and a duty ratio. However, as the second switch SW2 is turned on, the impedance may be varied according to the second impedance value by the second resistor R2 and thus the frequency level of the first PWM signal pwm_1 inputted to the switch unit 140 may be lowered.

Afterwards, the first PWM signal pwm_1 may be supplied, the time delay unit 136 may delay a point of time, and the PWM circuit unit 120 may then output the second PWM signal pwm_2 such that the latching current Id for maintaining the contact of the moving contactor or the moving core is supplied.

The control unit 150 may turn on the second switch SW2 such that the second PWM signal pwm_2 is supplied, so as to lower the frequency level of the second PWM signal pwm_2.

That is, when the second switch SW2 is turned on, the impedance may be adjusted according to the second impedance value of the second resistor R2, such that the frequency level of the second PWM signal pwm_2 can be adjusted to be lower than the frequency level of the second PWM signal pwm_2, which is output from the PWM circuit unit 120.

That is, as illustrated in FIG. 6, the frequency level of the second PWM signal pwm_2 outputted from the PWM circuit unit 120 may be a high level, but the frequency level of the second PWM signal pwm_2 supplied to the switch unit 140 can be varied to be lower than the high level.

Figure 7:
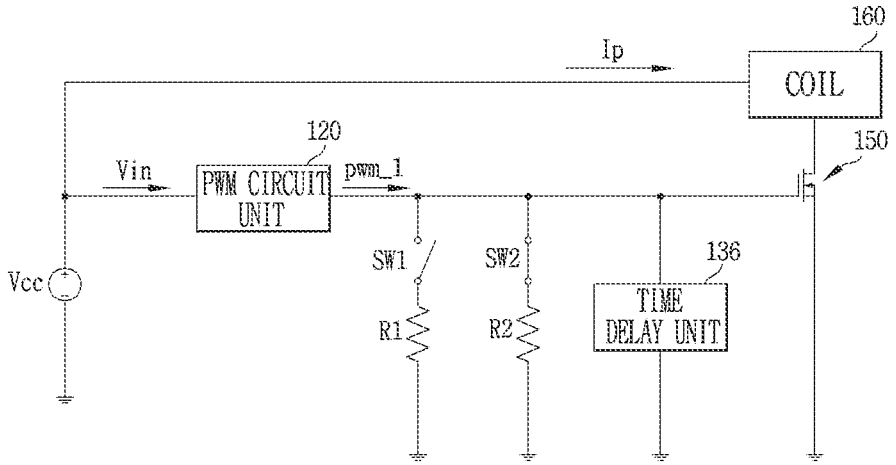
FIG. 7 is an operation circuit diagram illustrating a third implementation of a coil driving device for a magnetic contactor and a relay according to the present disclosure.
Figure 7:
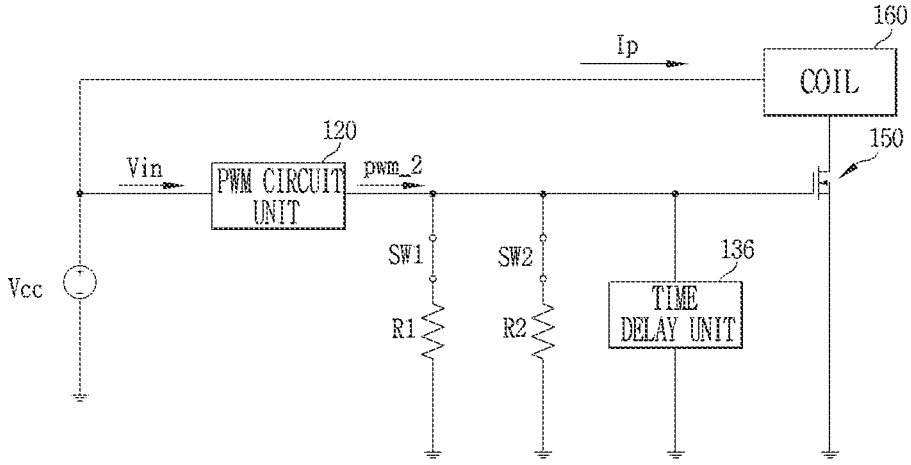
Figure 8:
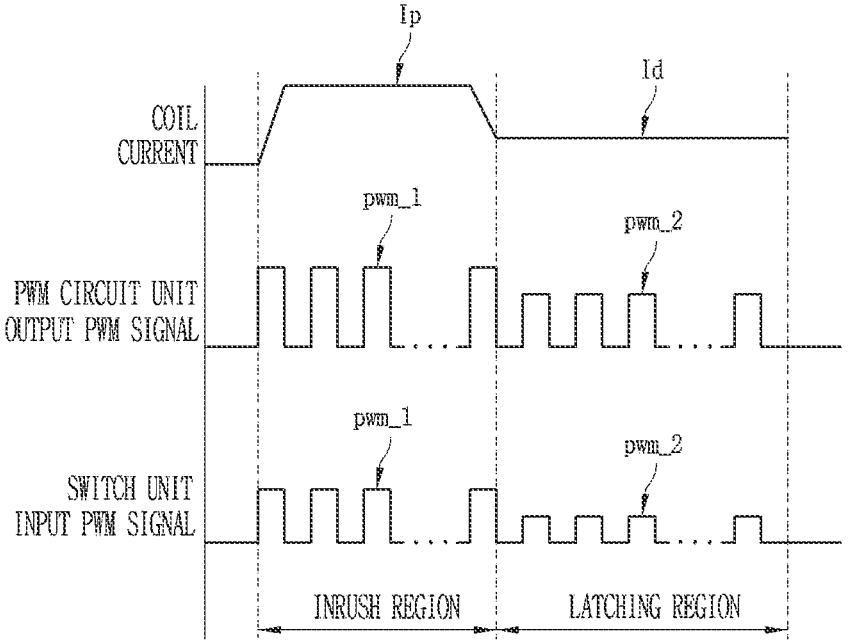
FIG. 8 is a PWM signal and a PWM signal inputted to a switch unit in the operation circuit diagram of FIG. 7.

FIG. 7 is an operation circuit diagram illustrating a second implementation of a coil driving device for a magnetic contactor and a relay according to the present disclosure, and FIG. 8 illustrates a PWM signal and a PWM signal inputted to a switch unit in the operation circuit diagram of FIG. 7.

First, FIGS. 7 and 8 illustrate a circuit operation and a PWM signal when the input voltage Vin belongs to the third voltage range.

First, the PWM circuit unit 120 may output the first PWM signal pwm_1 for supplying the inrush current Ip for initial driving of the moving contactor or the moving core included in the coil 160 according to the input voltage Vin.

At this point, when the input voltage Vin detected by the input voltage sensing unit 110 belongs to the third voltage range, the control unit may confirm that the input voltage Vin is an overvoltage.

The control unit 150 may turn off the first switch SW1 and turn on the second switch SW2 such that the first PWM signal pwm_1 is supplied to the switch unit 140.

As illustrated in FIG. 8, the first PWM signal pwm_1 may be outputted with a frequency and a duty ratio. However, as the second switch SW2 is turned on, the impedance may be varied according to the second impedance value of the second resistor R2 and thus the frequency level of the first PWM signal pwm_1 inputted to the switch unit 140 may be lowered.

Afterwards, the first PWM signal pwm_1 may be supplied, the time delay unit 136 may delay a point of time, and the PWM circuit unit 120 may output the second PWM signal pwm_2 such that the latching current Id for maintaining the contact of the moving contactor or the moving core is supplied.

The control unit 150 may turn on the first and second switches SW1 and SW2 such that the second PWM signal pwm_2 is supplied, so as to lower the frequency level of the second PWM signal pwm_2.

That is, when the first and second switches SW1 and SW2 are turned on, the impedance may be adjusted according to the first and second impedance values of the first and second resistors R1 and R2, such that the frequency level of the second PWM signal pwm_2 can be adjusted to be lower than the frequency level of the second PWM signal pwm_2, which is output from the PWM circuit unit 120.

That is, as illustrated in FIG. 8, the frequency level of the second PWM signal pwm_2 outputted from the PWM circuit unit 120 may be a high level, but the frequency level of the second PWM signal pwm_2 supplied to the switch unit 140 may vary to be lower than the frequency level of the second PWM signal pwm_2 illustrated in FIG. 6.

In regard to the first and second PWM signals pwm_1 and pwm_2 illustrated in FIGS. 3 to 8, at least one of the duty ratio and the frequency may vary depending on the input voltage Vin. Accordingly, even when the input voltage Vin is changed, the inrush current Ip and the latching current Id inputted to the coil 160 can be maintained constantly.

Features, structures, effects, and the like described in the implementations may be included in at least one implementation of the present disclosure, and are not necessarily limited to only one implementation. Furthermore, features, structures, effects, and the like illustrated in each implementation may be combined or modified with respect to other implementations by those skilled in the art to which the implementations belong. Therefore, contents related to such combinations and modifications should be construed as being included in the scope of the present disclosure.

In addition, the foregoing description has been made with reference to the implementations, but it is merely illustrative and is not intended to limit the present disclosure. It will be apparent that other changes and applications can be made by those skilled in the art to which the present disclosure belong without departing from substantial features of the implementations of the present disclosure. For example, each component specifically illustrated in the implementation can be modified and practiced. And it should be construed that differences relating to such changes and applications are included in the scope of the present disclosure defined in the appended claims.

The invention claimed is:

1. A coil driving device, comprising:

an input voltage sensing unit for detecting an input voltage;

a switch unit configured to make a switching operation to supply a driving current to a coil;

a pulse width modulation (PWM) circuit unit for outputting a PWM signal for the switching operation of the switch unit;

an impedance adjustment unit for changing an impedance value such that the PWM signal is adjusted, thereby limiting the driving current; and a control unit for causing the impedance adjustment unit to change the impedance value on the basis of the input voltage, thereby adjusting at least one of the duty ratio of the PWM signal and the frequency thereof.

2. The coil driving device of claim 1, wherein the driving current comprises at least one of an inrush current for initial driving of a moving contactor or a moving core included in the coil, and a latching current for maintaining contact of the moving contactor or the moving core.

3. The coil driving device of claim 2, wherein the PWM circuit unit outputs the PWM signal comprising at least one of a first PWM signal for supplying the inrush current and a second PWM signal for supplying the latching current.

4. The coil driving device of claim 1, wherein the impedance adjustment unit comprises:

a first impedance unit having a first impedance value;

a second impedance unit having a second impedance value smaller than the first impedance value; and a time delay unit to delay a point of time to supply the second PWM signal after the first PWM signal changed by the first and second impedance units is supplied to a switching element.

5. The coil driving device of claim 4, wherein the first and second impedance units are connected in parallel to each other, wherein the first impedance unit comprises a first resistor having the first impedance value and a first switch connected to the first resistor, and wherein the second impedance unit comprises a second resistor having the second impedance value and a second switch connected to the second resistor.

6. The coil driving device of claim 5, wherein the first and second impedance units, when the first and second switches make the switching operation according to a control of the control unit, varies the impedance value according to the first and second impedance values so as to adjust at least one of the duty ratio and the frequency of the PWM signal.

7. The coil driving device of claim 5, wherein the control unit comprises:

a determination unit to determine to which one of set first, second, and third voltage ranges the input voltage belongs; and a driving control unit to control the first and second impedance units and the time delay unit according to a determination result of the determination unit.

8. The coil driving device of claim 7, wherein the driving control unit, when it is determined that the input voltage belongs to the first voltage range, turns off the first and second switches to maintain the impedance value as a high impedance, such that the first PWM signal for supplying the inrush current is maintained at a high level, controls the time delay unit to delay a point of time after the first PWM signal is supplied, and then turns on the second switch to supply the second PWM signal for supplying the latching current.

9. The coil driving device of claim 7, wherein the driving control unit, when it is determined that the input voltage belongs to the second voltage range, turns off the first switch and turns on the second switch to maintain the impedance value as a medium impedance by the second impedance value such that the first PWM signal for supplying the inrush current is supplied, controls the time delay unit to delay a point of time after the first PWM signal is supplied, and then turns on the second switch such that the second PWM signal for supplying the latching current is supplied.

10. The coil driving device of claim 7, wherein the driving control unit, when it is determined that the input voltage belongs to the third voltage range, turns off the first switch and turns on the second switch to maintain the impedance value as a medium impedance by the second impedance value such that the first PWM signal for supplying the inrush current is supplied, controls the time delay unit to delay a point of time after the first PWM signal is supplied, then turns on the first and second switches such that the second PWM signal for supplying the latching current is supplied, and thus varies the impedance value as a low impedance by the first and second impedance value.

11. The coil driving device of claim 7, wherein the driving control unit controls the first and second PWM signals such that a duty ratio thereof is shortened and a frequency level is lowered as the voltage range to which the input voltage belongs changes from the first voltage range to the third voltage range.

12. The coil driving device of claim 1, further comprising:

a rectifier to output the input voltage rectified from an alternating-current (AC) voltage to a direct current (DC) type.

13. The coil driving device of claim 1, wherein the input voltage sensing unit comprises a voltage sensor to detect the input voltage.

14. The coil driving device of claim 1, wherein the switch unit is turned on and off by the PWM signal varied by the impedance adjustment unit.

15. The coil driving device of claim 1, wherein the impedance adjustment unit comprises:

a plurality of impedance units; and a time delay unit to delay a point of time to supply the PWM signal changed by the plurality of impedance units, and wherein the plurality of impedance units have different impedance values.

* * * * *